United States Patent [19]

Strauss

[11] Patent Number: 5,019,753

[45] Date of Patent: May 28, 1991

[54] LAMP STRUCTURE WITH COAXIAL RING SWITCH MODULE

[76] Inventor: Leo Strauss, 18 Judith Ct., East Rockaway, N.Y. 11518

[21] Appl. No.: 488,263

[22] Filed: Mar. 5, 1990

[51] Int. Cl.[5] ..... F21S 1/12

[52] U.S. Cl. ..... 315/362; 362/410

[58] Field of Search ..... 315/362; 362/410, 411, 362/412; 200/51.14

[56] References Cited

U.S. PATENT DOCUMENTS

| | | | |
|---|---|---|---|
| 1,701,476 | 2/1929 | Miller | 200/51.14 |
| 2,097,187 | 10/1937 | Horn | 362/410 |
| 2,194,619 | 3/1940 | Scruggs | 200/571 |
| 2,454,667 | 11/1948 | Morse | 200/567 |
| 2,470,643 | 5/1949 | Rath | 200/571 |

*Primary Examiner*—Eugene R. Laroche
*Assistant Examiner*—Ali Neyzari
*Attorney, Agent, or Firm*—James P. Malone

[57] ABSTRACT

Electric lamp has a base. A vertical support member is mounted on the base. An electric socket is mounted on the vertical member. A rotary electric switch is connected to the socket and mounted on the vertical member. An operating ring is connected to the switch, the ring encircling the vertical support member, whereby the switch may be operated from any point on its periphery and is easy to find and operate.

1 Claim, 2 Drawing Sheets

FIG. 4
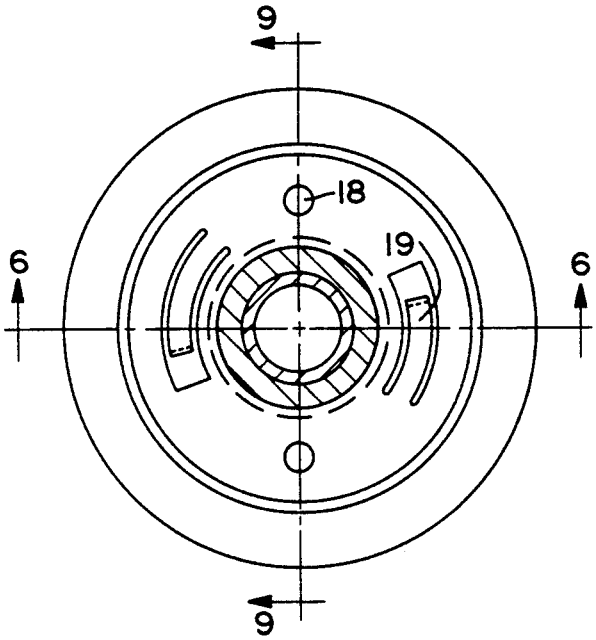
FIG. 5
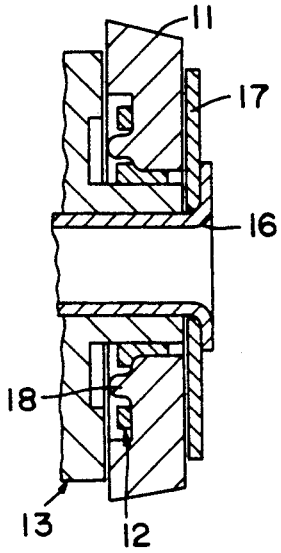
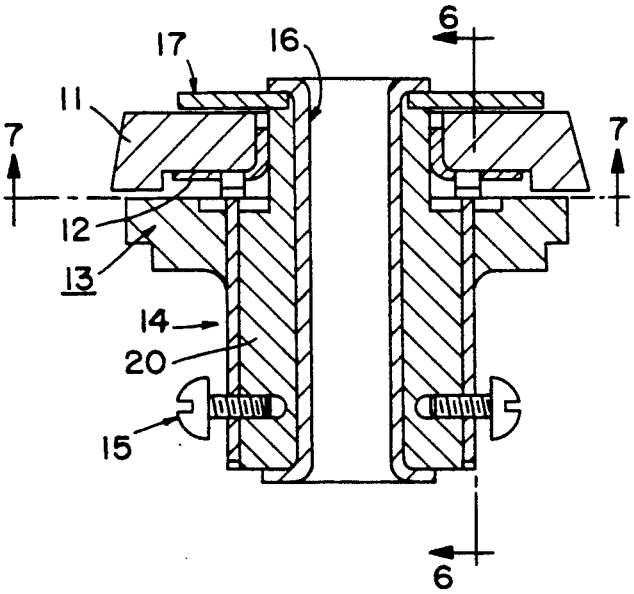
FIG. 2
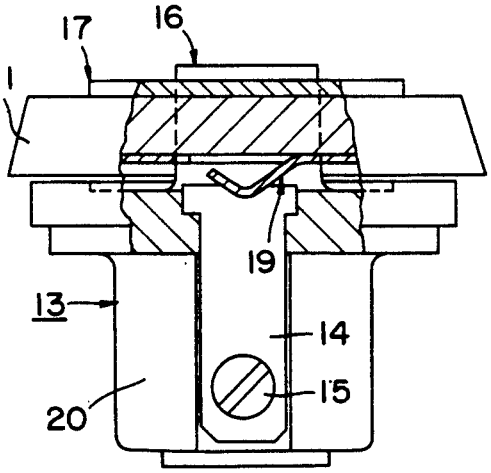
FIG. 3

LAMP STRUCTURE WITH COAXIAL RING SWITCH MODULE

This invention relates to common household electric lamps including table lamps, floor lamps, reflector floor lamps and similar lighting fixtures.

BACKGROUND

In such lamps, the electric switch controlling the lighting mode is generally located in an inconvenient or unsightly position, i.e.;

(a) at the bulb socket atop the lamp pedestal and above the lower edge of the lamp shade in a particular radial orientation, often requiring a person operating the switch to blindly feel for the hidden switch or look up into a bright light, (b) or, in the base or ornamental pedestal with the switch knob protruding through the surface ornamentation in an unsightly manner, (c) or, in the lamp cord outside the lamp base, being messy and unsightly as well as often being inconvenient.

PRIOR ART

U.S. Pat. No. 1,701,476, Safety Socket, Miller

U.S. Pat. No. 2,194,619, Switch for Hand Operated Electrical Devices, Scruggs

U.S. Pat. No. 2,454,667, Attachment Cord Anchorage With Ball Contact Switch, Morse U.S. Pat. No. 2,470,643, Light Switch, Rath

OBJECTS OF THE INVENTION

It is the object of this invention to provide a lamp switch that can be operated from any chosen position around the lamp, and at any chosen elevation from base to lamp socket, and that would eliminate the switch knob protruding through the shell and ornaments, and that could be easily and efficiently assembled onto common lamp constructions, and whose design would be ornamentally fit into the lamp ornamental design. It therefore provides for a wider range and more artistic design of lamp decorative art, as well as more convenient operation of the lamp switch.

Another object of the invention is to provide new and improved lamp means.

Another object of the invention is to provide a new and improved lamp with a rotary switch.

Another object of the invention is to provide a new and improved electric lamp comprising a base, a vertical support member mounted on the base, an electric socket mounted on the vertical member, a rotary electric switch connected to the socket and mounted on the vertical member, and an operating ring connected to the switch, the ring encircling the vertical support member, whereby the switch may be operated from any point on its periphery and is easy to find and operate.

Another object of the invention is to provide a lamp structure in which a switch module can be assembled at any convenient, preselected height from the base to the bulb receptacle, in which the switch operating member will be visible and easy to operate from any radial position, in which the switch operating member may be symmetrical with and may match the shape and ornamentation of the pedestal, enhancing the appearance of the lamp and which can be assembled from most components commonly used in the manufacture of lamps.

THE INVENTION

In accordance with the present invention, a lamp structure is provided which can be assembled with the subject coaxial ring switch module, providing a smooth flowing ornamental pedestal shape, including the switch operating member and in which the switch operating member will be immediately visible below the lamp shade and can be operated from any radial orientation.

In addition, this lamp structure may be manufactured mostly from commonly available lamp components and assembly techniques; i.e., by axially clamping base and pedestal components together, as well as the subject switch module, onto a central rigid tube; all other lamp components, including bulb receptacle, wiring, lamp shade and shade holder being as commonly used.

BRIEF DESCRIPTION OF FIGURES

FIG. 2 is a cross section of a switch module taken on Line 8—8 of FIG. 4.

FIG. 3 is a partial section taken on Line 6—6.

FIG. 4 is a view taken on Line 7—7.

FIG. 5 is a partial section taken on Line 9—9.

DESCRIPTION OF PREFERRED EMBODIMENTS

Figure 1:
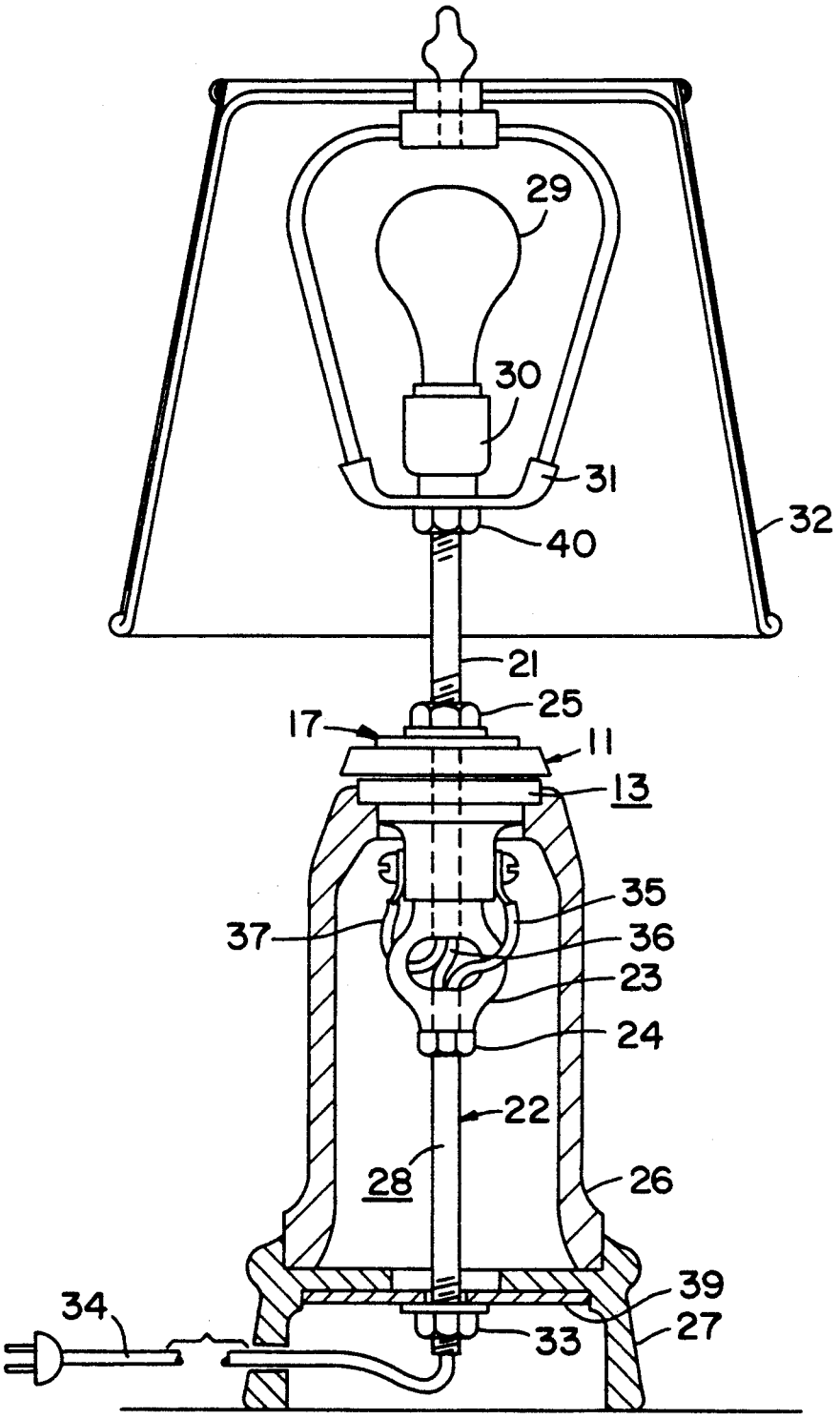
FIG. 1 is a cross section of a typical table lamp.

In this first embodiment, shown in FIG. 1, the ornamental stand which supports the lamp is comprised of base 27 and an inverted jar shaped pedestal 26. The top face of pedestal 26 has a stepped bored hole in which switch module 13 rests. A cross section of switch module 13, shown in FIG. 2, shows a unitized subassembly, held together by a central sleeve 16 whose ends are flanged outward, tightly capturing the switch body 20 and cap 17, with the coaxial ring operating member 11 retained between cap 17 and a shelf portion of switch body 20, and rotatable on a cylindrical portion of switch body 20.

Returning to FIG. 1, switch module 13 is coaxially mounted on the rigid center tube 21, which passes through sleeve 16 of the switch module 13 and is locked in place axially on tube 21 between nut 25, screwed onto tube 21 and the coupling fitting 23, which is screwed onto the end portion of tube 21. Fitting 23, in addition to having threaded holes in each end, has side openings to provide access for wires to the inside of tube 21 and tube 22. Such a coupling fitting 23 is well known in the lighting industry as a "hickey". A rigid lower tube 22 is threaded into the lower end of fitting 23 and locked in place with locknut 24. This lower tube 22 extends down through a shelf portion of base 27 and through a hole in lower cap 39. Nut 33 screws onto lower end of tube 22 and is tightened against lower cap 39, thereby axially clamping together the assembly of base 27, pedestal 26, switch module 13 and cap 17 onto the core tube assembly 28, comprising lower tube 22, fitting 23 and upper tube 21.

However, before screwing nut 33 onto threaded end of tube 22, the lamp cord 34 is inserted into an opening in base 27, passed into the open end of tube 22 and up to the fitting 23. One lead wire 35 of the lamp cord 34 is cut to suitable length and passed out one side opening of fitting 23 and connected to one terminal 15 of switch module 13. A second lead wire 36 of lamp cord 34 is passed through the fitting 23 and up into the upper tube 21 and into bulb 29 receptacle 30, where it is connected to one terminal of the bulb receptacle 30 in the manner commonly used.

A third, separate lead wire 37 is connected to a second terminal 15 of the switch module 13 and then passed into a side opening of fitting 23 and up inside of upper tube 21 and into the bulb receptacle 30, where it is connected to a second terminal in the manner commonly used in lamps.

The cross section of the switch module 13, shown in FIG. 2, shows this switch module 13 comprised of an insulating body 20, conductive contact plates 14, secured in body 20 and extending through the shelf portion of body 20. The upper surfaces of contact plates 14 are exposed and have a "V" notch. Above the shelf portion of body 20, and retained by cap 17, is the switch ring operating member 11 made of insulating material which is rotatable about a cylindrical portion of body 20 above the shelf portion of the body 20. Shade 32 is mounted on bracet 31, FIG. 1.

A contact plate 12, made of conductive material, has two spring fingers 19 which have "V" formed ends which can fit into the "V" notches of the contact plates 14 under spring bias when the ring operating member 11 is rotated and, consequently, rotates contact plate 12 by means of the drive pins 18. As is obvious, when the contact plate 12 is rotated so that the spring fingers 19 engage the contact plates 14, then the contact plates 14 will be conductively bridged; and, conversely, when the contact plate 12 rotates to disengage the spring fingers 19 from the contact plates 14, then the contact plates 14 will be insulated from each other.

As previously noted, the switch components are retained as an assembled module 13 by the sleeve 16 and flanges, and the switch ring operating member 11 is coaxial with the sleeve 16 and are both coaxial with the lamp core tube assembly 28.

This detailed description of one embodiment of this invention illustrates a single pole, single throw electrical circuit arrangement for controlling one way light bulbs. However, it is understood that other embodiments of this invention can provide other common electrical circuits for controlling two way and three way bulbs, as well as electronic dimmer circuits for controlling light bulbs.

What is claimed is:

1. Electric lamp comprising:

a base, a rigid tubular core member supported on said base, an electric light bulb receptacle mounted on said rigid tubular core member, means for controlling the light mode of the lamp electrically connected to said electric light bulb receptacle and coaxially mounted on said rigid tubular core member, an external operating ring rotatable on a cylindrical portion of insulated body member included in and coaxial with said means for controlling the lighting mode of the lamp, whereby said means for controlling the lighting mode of the lmap may be operated from any point on its periphery and is easy to find and operate, wherein said base, pedestal members adjacent to said base, and an insulated body member included in said means for controlling the lighting mode of the lamp, are coaxially clamped in end-to-end arrangement onto said rigid tubular core member, said tubular core member passing through axial openings in said base, said pedestal members, said insulated body member, and abutment means for axially clamping said base, said pedestal members and said insulated body member in tight assembly onto said rigid tubular core member.

* * * * *